United States Patent [19]

Linder et al.

[11] Patent Number: 4,474,163

[45] Date of Patent: Oct. 2, 1984

[54] DEVICE FOR THE IMPROVEMENT OF COMBUSTION IN INTERNAL COMBUSTION ENGINES

[75] Inventors: Ernst Linder, Mühlacker; Helmut Maurer, Vaihingen, both of Fed. Rep. of Germany

[73] Assignee: Robert Bosch GmbH, Stuttgart, Fed. Rep. of Germany

[21] Appl. No.: 421,670

[22] Filed: Sep. 22, 1982

[30] Foreign Application Priority Data

May 13, 1982 [DE] Fed. Rep. of Germany ..... 3218018

[51] Int. Cl.[3] ..... F02M 29/00

[52] U.S. Cl. ..... 123/590; 123/188 M; 123/73 V; 261/79 R; 48/180 R

[58] Field of Search ..... 123/590, 188 M, 52 MF, 123/73 V; 48/180 M, 180 S; 261/79 R

[56] References Cited

U.S. PATENT DOCUMENTS

| | | | |
|---|---|---|---|
| 1,703,493 | 2/1929 | Leach | 48/180 B |
| 3,965,873 | 6/1976 | Konomi et al. | 123/188 M |
| 4,058,102 | 11/1977 | Fabritz | 123/590 |
| 4,180,042 | 12/1979 | Lloyd | 123/590 |

FOREIGN PATENT DOCUMENTS

| | | | |
|---|---|---|---|
| 48856 | 1/1931 | Austria | 261/79 R |
| 2259246 | 8/1975 | France | 48/180 B |
| 2059504 | 1/1981 | United Kingdom | 48/180 M |

*Primary Examiner*—Charles J. Myhre
*Assistant Examiner*—E. Rollins Cross
*Attorney, Agent, or Firm*—Edwin E. Greigg

[57] ABSTRACT

An apertured shield is disclosed having spring tongues, pointing radially inwards, each of the tongues having two lateral limiting edges and a longitudinal extent terminating in an irregular edge all of which edges define together an aperture. Adjacent spring tongues are overlapped in an area on the limiting edges, and are connected together at the circumference of the shield by being flanged into a retainer ring. The apertured shield is disposed in close proximity to the injection valve to cause a turbulence with superimposed spin flow of the medium flowing into the combustion chamber of an internal combustion engine.

4 Claims, 3 Drawing Figures

DEVICE FOR THE IMPROVEMENT OF COMBUSTION IN INTERNAL COMBUSTION ENGINES

BACKGROUND OF THE INVENTION

The invention is directed to a shield having spring tongues which deflect inwardly in response to flow in the intake pipe of an internal combustion engine having spark ignition. Such a device is shown in German Offenlegungsschrift No. 26 41 066, the spring tongues of which are deflected from their radial position of rest by the flow medium in such a way that with rising flow medium pressure throughput the flow diameter of the apertured shield is automatically increased. This leads to a turbulence of the medium in the intake pipe, resulting in a good mixture preparation and favorable ignition conditions as well as a rapid flame propagation in the mixture compressing chamber of an internal combustion engine with external ignition. Experience shows that the improvement in combustion achieved with this shield often is not sufficient, especially in high-load internal combustion engines.

OBJECT AND SUMMARY OF THE INVENTION

It is a principal object of the present invention to provide an improved shield wherein a spin flow is superimposed on the turbulence without the need for additional parts, which considerably improves the combustion in the internal combustion engine and suppresses knocking during combustion.

It is another object of the present invention to provide that the turbulence and spin flow imparted to the flow of fuel-air mixture is delivered to the ignition zone in the cylinder head, thus additionally improving the combustion.

It is still another object of the invention to improve upon the aperture of known shields which take the form of a circle, so that the shear edge formed is other than perfectly circular.

It is yet another object of the invention to provide additional refined turbulence of the medium flowing through the shield by aperturing the spring tongues.

It is still a further object to provide a shield which is simple to construct and safe in use.

It is yet an additional object to provide that the opening for flow through the shield can be operatively changed by a variant in the directional orientation and shape of the tongues. The amount of concavity applied to the spring tongues can be used to vary the flow-through characteristics of the medium.

It is still an additional object of the present invention to provide an increase in the charge movement and, with that, an improved combustion of lean fuel mixtures as well as a favorable displacement of the knock limit.

It is still another object to provide a shield which can be retrofitted as an intermediate flange in almost all types of vehicle engines and is easily mass-produced.

The invention will be better understood and further objects and advantages thereof will become more apparent from the ensuing detailed description of a preferred embodiment taken in conjunction with the drawings.

BRIEF DESCRIPTION OF THE DRAWINGS

An exemplary embodiment of the present invention is shown in the drawings and explained in more detail in the description.

DESCRIPTION OF THE PREFERRED EMBODIMENT

Figure 1:
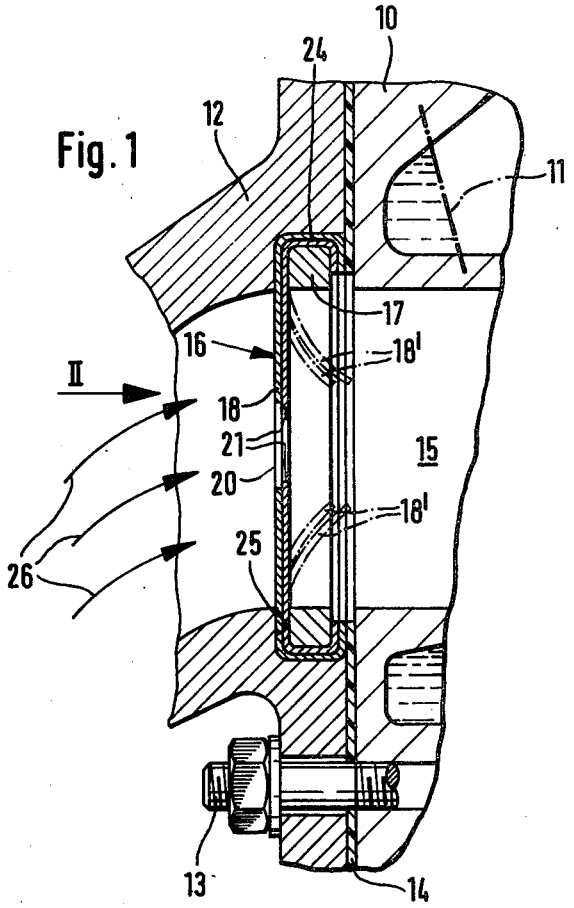
FIG. 1 is a partial cross-section of a segment of the cylinder head and adjacent intake pipe in full size.

FIG. 1 shows a cylinder head 10 of an internal combustion engine with an intake valve 11 sketched in and an intake pipe 12 laterally screwed to the cylinder head 10 on top of a gasket 14 by means of several screws 13. A section of the combustion chamber of the cylinder head, not shown in detail, is designated with the numeral 15. An apertured shield 16 is provided between intake pipe 12 and cylinder head 10 which comprises a retainer ring 17 and twelve spring tongues 18 which consist of an elastic material which is heat resistant up to 150° C.

Figure 2:
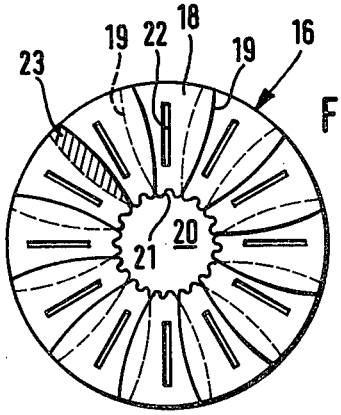
FIG. 2 is an end elevational view of the operative side of the shield taken from the direction indicated as II in FIG. 1.

Referring now to FIG. 2, each spring tongue 18 has two lateral limiting edges 19 of a convex configuration and a central wavy edge 21, oriented towards a central aperture 20; all of these central wavy edges taken together form a shear edge. Each spring tongue 18 has a longitudinal slit 22 closed on all sides. The tongues are disposed radially in a partially overleaved manner, i.e., the lateral limiting edges 19 of each spring tongue overlap on the two adjacent spring tongues.

The overlapping of the spring tongues 18 is indicated as the shaded area 23 of the limiting edges 19 of two adjacent spring tongues 18, which are locked together in these areas 23 at the outer region 24. The outer regions 24 of the spring tongues 18 are angularly flanged to the retainer ring 17. An annular groove 25 is provided in the front face of the intake pipe 12 for retaining the apertured shield 16. The annular groove has such a diameter that, upon fastening the intake pipe 12 on the cylinder head 10, the apertured shield 16 is secured at the same time. In this manner the apertured shield 16 is placed as closely as possible to the intake valve 11.

Referring again to FIG. 1, the apertured shield 16 with its radially placed spring tongues 18 is shown while the engine is not in operation. When the engine is in operation, the medium flows in the direction of the arrow 26 through the intake pipe 12, deflecting the spring tongues 18 into a position 18', shown by broken lines, whereby the flow-through diameter of the apertured shield 16 automatically increases. At full load of the internal combustion engine this construction results in an insignificant throttling of the flowing medium and does produce less turbulence and spin flow.

Figure 3:
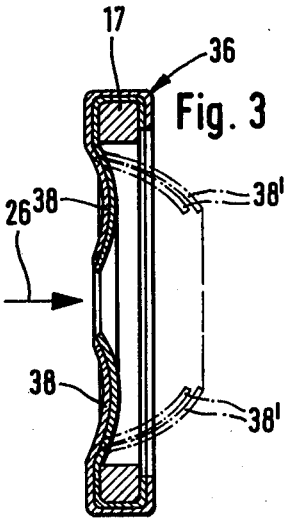
FIG. 3 is a segmental cross-section of a variant form of the aperture shield.

The second variation of the aperture shield 36 in FIG. 3 shows the retainer ring 17 and two of the eighteen spring tongues 38; each spring tongue is formed concave, so that the central wavy edge points opposite to the flow direction 26. The flowing medium will similarly deflect all spring tongues 38 into the position 38' shown by broken lines. By varying the extent of the concave shape, the flow-through characteristic of the medium can be changed.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A device for the improvement of the combustion in internal combustion engines comprising an apertured shield disposed in an intake pipe transversely to flow of a medium therethrough, said apertured shield having spring tongues each provided with at least one opening directed substantially radially inwards from a circumferential retainer means and said spring tongues being disposed radially so as to overlap serially.

2. A device in accordance with claim 1, characterized in that said opening is a longitudinal slit having a length less than that of said spring tongue.

3. A device for the improvement of the combustion in internal combustion engines comprising an apertured shield disposed in an intake pipe transversely to flow of a medium therethrough, said apertured shield having spring tongues having two lateral limiting edges imparted with a convex shape directed substantially radially inwards from a circumferential retainer means, and said spring tongues being disposed radially so as to overlap serially.

4. A device for the improvement of the combustion in internal combustion engines having at least one combustion chamber and an intake valve comprising an apertured shield disposed in an intake pipe transversely to flow of a medium therethrough and abutting a cylinder head of said engine as close as possible to the intake valve, said apertured shield having spring tongues having two lateral limiting edges imparted with a convex shape directed substantially radially inwards from a circumferential retainer means, and said spring tongues being disposed radially so as to overlap serially.

* * * * *